US008830157B2

(12) United States Patent
Ichikawa et al.

(10) Patent No.: US 8,830,157 B2
(45) Date of Patent: Sep. 9, 2014

(54) DISPLAY APPARATUS, QUANTITY-OF-LIGHT ADJUSTING METHOD FOR DISPLAY APPARATUS AND ELECTRONIC EQUIPMENT

(75) Inventors: Hiroaki Ichikawa, Kanagawa (JP); Kenichi Kikuchi, Kanagawa (JP); Kimio Hatajiri, Kanagawa (JP)

(73) Assignee: Sony Corporation (JP)

( * ) Notice: Subject to any disclaimer, the term of this patent is extended or adjusted under 35 U.S.C. 154(b) by 1177 days.

(21) Appl. No.: 12/287,178

(22) Filed: Oct. 7, 2008

(65) Prior Publication Data

US 2009/0096724 A1 Apr. 16, 2009

(30) Foreign Application Priority Data

Oct. 16, 2007 (JP) ..... 2007-268576

(51) Int. Cl.
*G09G 3/34* (2006.01)
*H05B 33/08* (2006.01)

(52) U.S. Cl.
CPC ..... *H05B 33/0869* (2013.01); *G09G 2320/041* (2013.01); *G09G 2320/0666* (2013.01); *G09G 2320/064* (2013.01); *G09G 2360/145* (2013.01)
USPC ..... 345/102; 345/82; 345/690

(58) Field of Classification Search
CPC . G09G 3/3406; G09G 2320/0626–2320/0653; H05B 31/00–33/0896
USPC ..... 345/82, 102
See application file for complete search history.

(56) References Cited

U.S. PATENT DOCUMENTS

| | | | | |
|---|---|---|---|---|
| 5,162,987 | A | 11/1992 | Sambhu | |
| 5,568,044 | A * | 10/1996 | Bittner | 323/272 |
| 6,208,533 | B1 * | 3/2001 | Ogawa | 363/21.08 |
| 2002/0067332 | A1 * | 6/2002 | Hirakata et al. | 345/102 |
| 2002/0080631 | A1 * | 6/2002 | Kanouda et al. | 363/62 |
| 2003/0016205 | A1 * | 1/2003 | Kawabata et al. | 345/102 |
| 2005/0052168 | A1 * | 3/2005 | Tazawa et al. | 323/282 |
| 2005/0083274 | A1 * | 4/2005 | Beddes et al. | 345/82 |

(Continued)

FOREIGN PATENT DOCUMENTS

| | | | |
|---|---|---|---|
| EP | 1775711 | A1 * | 4/2007 |
| JP | 2003006906 | A | 1/2003 |

(Continued)

OTHER PUBLICATIONS

Susumu Tadakuma et al, Iimproved PWM Control for GTO Inverters with Pulse Number Modulation, IEEE Transactions on Industry Applications, IEEE Service Center, Piscataway, NJ, US, vol. 32, No. 3, Jun. 1, 1996 (supplied by Applicant on IDS dated Apr. 13, 2010).*

(Continued)

*Primary Examiner* — Dorothy Harris
(74) *Attorney, Agent, or Firm* — Lerner, David, Littenberg, Krumholz & Mentlik, LLP

(57) ABSTRACT

A display apparatus includes display means for displaying an image, a light source that irradiates light to the display means, and control means for controlling the quantity of light of the light source with pulse width modulation. The control means controls the quantity of light of the light source based on the ratio of the light-on period with pulse width modulation to the light-off period when the light source is turned off.

10 Claims, 18 Drawing Sheets

(56) References Cited

U.S. PATENT DOCUMENTS

| | | | | |
|---|---|---|---|---|
| 2005/0140640 | A1* | 6/2005 | Oh et al. | 345/102 |
| 2005/0231459 | A1* | 10/2005 | Furukawa | 345/102 |
| 2006/0007097 | A1* | 1/2006 | Ichikawa | 345/102 |
| 2006/0125773 | A1* | 6/2006 | Ichikawa et al. | 345/102 |
| 2006/0170370 | A1* | 8/2006 | De Anna | 315/185 S |
| 2007/0115228 | A1 | 5/2007 | Roberts et al. | |
| 2008/0074381 | A1* | 3/2008 | Kumamoto | 345/102 |
| 2008/0100232 | A1* | 5/2008 | Miguchi | 315/294 |
| 2008/0191642 | A1* | 8/2008 | Slot et al. | 315/295 |
| 2008/0198117 | A1* | 8/2008 | Kumakura | 345/89 |

FOREIGN PATENT DOCUMENTS

| | | | |
|---|---|---|---|
| JP | 2005258403 | A | 9/2005 |
| JP | 2005-310997 | A | 11/2005 |
| JP | 2005312551 | A | 11/2005 |
| JP | 2006053520 | A | 2/2006 |
| KR | 20020042492 | A | 6/2002 |
| WO | 03/032689 | A1 | 4/2003 |
| WO | WO 2006006404 | A1 * | 1/2006 |
| WO | WO 2006095743 | A1 * | 9/2006 |

OTHER PUBLICATIONS

Communication from EP Application No. 08166457, dated Oct. 17, 2011.

Office Action from Japanese Application No. 2007-268576, dated Dec. 13, 2011.

Tadakuma et al: Improved PWM Control for GTO Inverters with Pulse No. Modulation, IEEE Transactions on Industry Applications vol. 32, No. 3, May/Jun. 1996.

European Search Report, EP 08166457, dated Mar. 19, 2010.

Susumu Tadakuma et al: "Improved PWM Control for GTO Pulse Number Modulation" IEEE Transactions on Industry EEE Service Center, Piscataway, NJ, US, vol. 32, No. 3, Jan. 6, 2001), XP011022022.

Office Action from Japanese Application No. 2007-268576, dated Mar. 8 , 2011.

European Search Report, EP 08166457, dated Jul. 28, 2010.

Office Action from Korean Application No. 10-2008-0100989, dated Jun. 11, 2014.

* cited by examiner 141
142
143
144
145
146
147

DISPLAY APPARATUS, QUANTITY-OF-LIGHT ADJUSTING METHOD FOR DISPLAY APPARATUS AND ELECTRONIC EQUIPMENT

CROSS REFERENCES TO RELATED APPLICATIONS

The present application claims priority from Japanese Patent Application JP No. 2007-268576 filed in the Japanese Patent Office on Oct. 16, 2007, the entire content of which is incorporated herein by reference.

BACKGROUND OF THE INVENTION

1. Field of the Invention

The present invention relates to a display apparatus that displays an image by irradiating light from a light source to display means, a quantity-of-light adjusting method for a display apparatus and electronic equipment.

2. Description of the Related Art

Liquid crystal displays including a liquid crystal television may use an LED (or light emitting diode) device as a back light thereof for one advantage that the range of the luminance control is wider than that of a CCFL (Cold Cathode Fluorescent Lamp) (refer to JP-A-2005-310997 (Patent Document 1), for example).

The CCFL may also control the luminance and mainly includes two methods of voltage light control and current light control. The former is a method that feeds back the voltage to be applied to a transformer and adjusts the voltage for light control and has a light control range of 50 to 100% generally.

The latter is a method that feeds back output current and adjusts the voltage to be applied to a transformer for light control and has a light control range of approximately 50% to 100%, which is equal to that of the voltage light control. PWM (Pulse Width Modulation) light control is an alternative method. This method has an extended range of light control of approximately 10% to 100%.

Therefore, it is difficult to obtain a range of 10% or smaller even by performing PWM light control, and in order to obtain a light control range of 10% or smaller, it is said that a back light employing an LED device is superior.

A recent high-quality-demanded display apparatus such as a television may be driven by a control system to detect a color temperature at all times and receives the feedback for keeping a constant chromaticity since a constant color temperature is important even with various luminance levels.

Accordingly, control over luminance by using an LED back light is important. Here, the method for luminance control over an LED back light may be:

[1] PWM (Pulse Width Modulation) method that adjusts luminance in time;

[2] A method that adjusts current (current peak value) to be fed to an LED; or

[3] A method that uses [1] and [2]

The PWM method is a pulse modulation method that changes and modulates the width of pulses at a constant amplitude during a predetermined period according to the pulse width modulation and modulation signals. As the amplitude of signal waves increases, the width of pulses increases. As the amplitude decreases, the width of pulses decreases.

An LED back light is assumed here as an example that includes an LED array of a red LED, a green LED and a blue LED. Notably, there are no reasons for configuring LEDs for three colors as above, LEDs for other colors excluding the three colors may be mixed.

The three methods for controlling the luminance of the LED back light will be described more specifically.

[1] Case where PWM is Adjusted for Luminance Control

In PWM on the RGB LEDs, the pulse width is adjusted for each of the RGB LEDs to obtain an arbitrary white balance. If PWM is defined for a higher RGB lighting rate (such as 50% or higher), the light control only with PWM can keep a constant current value and keep the linearity in the relationship between PWM and the luminance. Defining PWM for a lower RGB lighting rate (such as 10% or lower) produces narrower current waveforms, which are susceptible to the rising and falling characteristics. From the viewpoint of designing a circuit for driving an LED, it is important to design a sophisticated LED driver that can stably output a current value and PWM even with a lighting rate of 10% or lower.

[2] Case where Current (or Current Peak Value) to be Fed to LED is Adjusted for Luminance Control The method that performs luminance control by adjusting a current peak value is required to adjust the current wave height value of lower current. Therefore, also in this case, sophisticated design is important for the driver circuit that lights LEDS.

[3] Case where Both PWM and Current Peak Value are Adjusted for Luminance Control The luminance control by adjusting both PWM and current peak value can extend the light control range more than those of [1] and [2]. However, it may disadvantageously complicate the algorithm for controlling the luminance to decrease or increase with the chromaticity kept constant. Preferably for simple control, one of PWM and the current peak value is used as a variable for luminance control, and the other is used for keeping the chromaticity.

SUMMARY OF THE INVENTION

However, it is difficult for the generally-considered three quantity-of-light adjusting method to keep constant chromaticity and decrease the luminance sufficiently.

Accordingly, it is desirable to provide a display apparatus including display means for displaying an image, a light source that irradiates light to the display means and control means for controlling the quantity of light of the light source with pulse width modulation, wherein the control means controls the quantity of light of the light source based on the ratio of the light-on period with pulse width modulation to the light-off period when the light source is turned off.

According to an embodiment of the invention, since a light-on period with pulse width modulation and a light-off period when the light source is turned off are provided so that the quantity of light of the light source can be adjusted with pulse width modulation based on the ratio. Therefore, the luminance of the light source can be sufficiently decreased by defining the pulse width for pulse width modulation so as to keep constant chromaticity.

In this case, in order to adjust the quantity of light of the light source to a predefined quantity of light or larger, the control means may perform control with the pulse width by defining the ratio of the light-on period at 100% until the pulse width of pulse width modulation corresponding to the quantity of light is obtained, and, in order to adjust the quantity of light of the light source to the quantity of light smaller than the predefined quantity of light, the control means may perform control with the ratio of the light-on period by keeping the pulse width constant. Thus, both of the stability of chromaticity and the adjustment of luminance can be obtained by performing the adjustment only with pulse width modulation in order to obtain a predefined quantity of light or larger and performing control with the ratio of the light-on period to the light-off period with a constant pulse width of pulse width modulation in order to obtain the quantity of light smaller than the predefined quantity of light.

In order to detect the quantity of light by light receiving means for performing feedback control over the quantity of light, the quantity of light by the light receiving means may be detected during a predetermined period within the light-on period.

According to another embodiment of the invention, there is provided a quantity-of-light adjusting method for a display apparatus, which controls with pulse width modulation the quantity of light of a light source irradiating light to display means for displaying an image, including the step of controlling the quantity of light of the light source with the ratio of the light-on period with the pulse width modulation to the light-off period when the light source is turned off.

According to this embodiment of the invention, since a light-on period with pulse width modulation and a light-off period when the light source is turned off are provided so that the quantity of light of the light source can be adjusted with pulse width modulation based on the ratio. Therefore, the luminance of the light source can be sufficiently decreased by defining the pulse width for pulse width modulation so as to keep constant chromaticity.

In this case, in order to adjust the quantity of light of the light source to a predefined quantity of light or larger, control with the pulse width may be performed by defining the ratio of the light-on period at 100% until the pulse width of pulse width modulation corresponding to the quantity of light is obtained, and, in order to adjust the quantity of light of the light source to the quantity of light smaller than the predefined quantity of light, control with the ratio of the light-on period may be performed by keeping the pulse width constant. Thus, both of the stability of chromaticity and the adjustment of luminance can be obtained by performing the adjustment only with pulse width modulation in order to obtain a predefined quantity of light or larger and performing control with the ratio of the light-on period to the light-off period with a constant pulse width of pulse width modulation in order to obtain the quantity of light smaller than the predefined quantity of light.

In order to detect the quantity of light by light receiving means for performing feedback control over the quantity of light based on the detected quantity of light, the quantity of light by the light receiving means may be detected during a predetermined period within the light-on period.

According to still another embodiment of the invention, there is provided electronic equipment having a display apparatus on a chassis, the display apparatus including display means for displaying an image, a light source that irradiates light to the display means, and control means for controlling the quantity of light of the light source with pulse width modulation, wherein the control means controls the quantity of light of the light source based on the ratio of the light-on period with the pulse width modulation to the light-off period when the light source is turned off.

According to this embodiment of the invention, in order to adjust the quantity of light of the light source provided on the display device with pulse width modulation, a light-on period with pulse width modulation and a light-off period when the light source is turned off are provided so that the quantity of light of the light source in the display apparatus can be adjusted with pulse width modulation based on the ratio. Therefore, the luminance of the light source can be sufficiently decreased by defining the pulse width for pulse width modulation so as to keep constant chromaticity. Therefore, the range of the luminance control in the display apparatus in the electronic equipment can be extended.

Therefore, according to the embodiments of the invention, the luminance can be sufficiently decreased with the chromaticity of a light source, which irradiates light to display means, kept constant.

DESCRIPTION OF THE PREFERRED EMBODIMENTS

With reference to drawings, embodiments of the invention will be described.

[Layout in LED Back Light]

Figure 1:
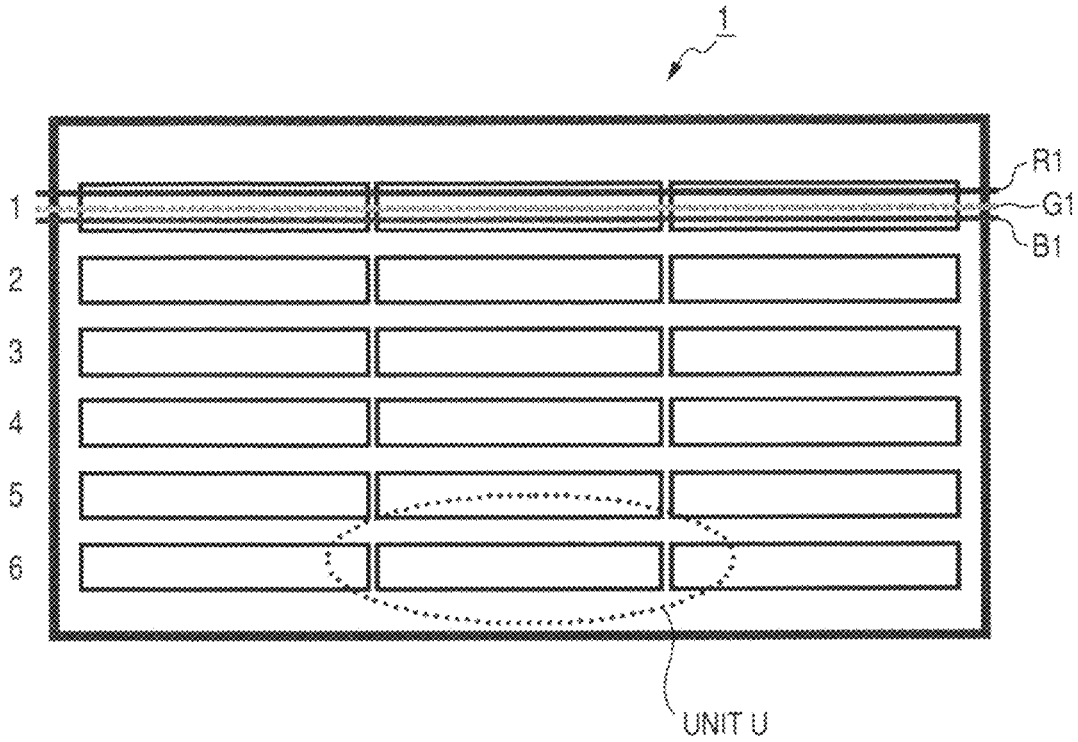
FIG. 1 is a schematic plan view illustrating the layout of LED back lights.

FIG. 1 is a schematic plan view illustrating the layout in an LED back light. An LED back light is placed at the back of display means (such as a liquid crystal panel) in a display apparatus 1 and supplies light to the display means. In the LED back light, one unit U has multiple R, G and B LEDs, and the units U are placed horizontally and vertically. As the area of the display means such as a liquid crystal panel increases, the number of units U disposed vertically and horizontally increases. However, one unit U may be provided for display means in a smaller area.

[Configuration of Unit]

Figure 2A:
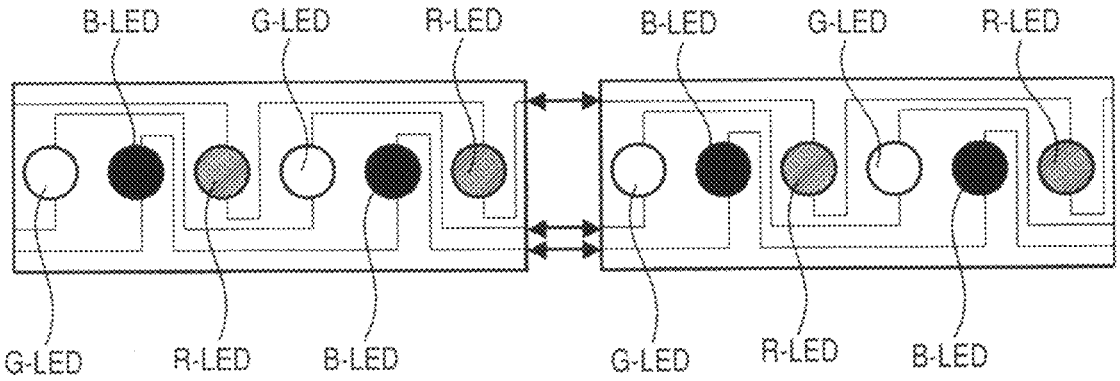
FIGS. 2A and 2B are schematic diagrams illustrating configurations of LED units employed in an LED back light.
Figure 2B:
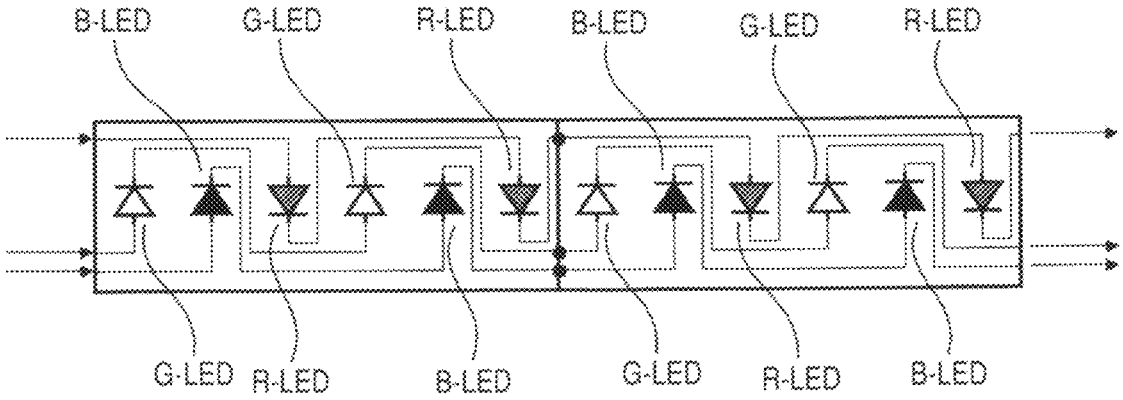

FIGS. 2A and 2B are schematic diagrams illustrating a configuration of an LED unit employed in an LED back light, and FIG. 2A is a layout diagram, and FIG. 2B is a circuit diagram. In one unit, R (red), G (green) and B (Blue) LEDs (or R-LED, G-LED and B-LED) are laid out in a predetermined order, and multiple LEDs in a same color are connected in series. Therefore, one unit has input lines and output lines for three colors, and the current given from an input line to an output line can cause the corresponding LED to emit light. While one unit includes LEDs for three colors of RGB according to an embodiment of the invention, the invention is not limited to the combination of the three colors.

[Light Control with General PWM (or Pulse Width Modulation)]

Figure 3:
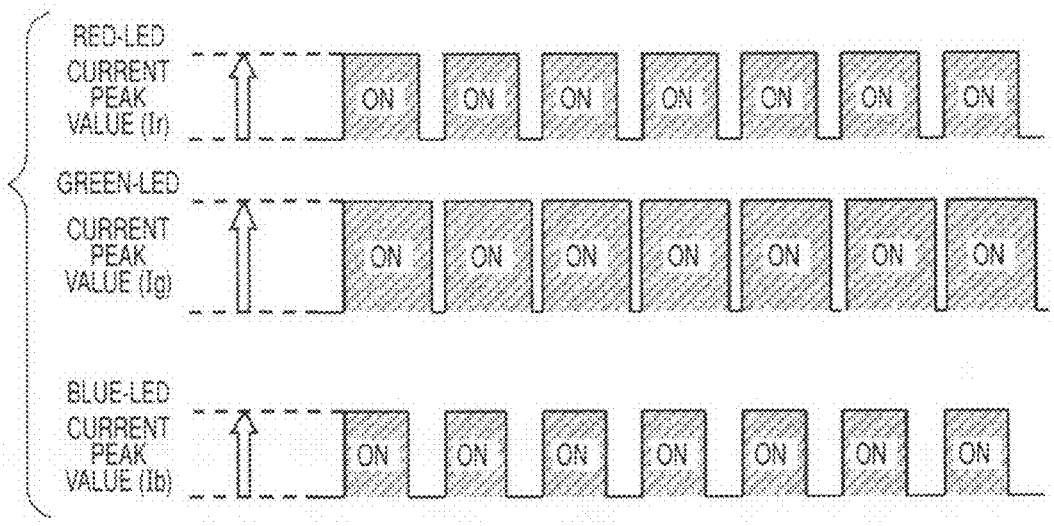
FIG. 3 is a schematic diagram illustrating general light control with PWM in an LED back light.

FIG. 3 is a schematic diagram illustrating light control with general PWM on an LED back light. The pulse width is adjusted in each of RGB such that the PWM of LEDs can produce an arbitrary white balance. If PWM is defined with a high lighting rate (such as 50% or higher) for RGB, the current peak value can be kept constant even under the light control with the PWM only. Therefore, the relationship between the PWM and the luminance can keep linearity.

On the other hand, if PWM is defined with a low lighting rate (such as 10% or lower), the current waveform becomes narrower and is susceptible to rising and falling characteristics. FIG. 3 is a schematic diagram illustrating a state with a lower lightening rate for PWM. A significantly lower lightening rate for PWM decreases the response characteristic at the rising and/or falling edges, and it is difficult to obtain a rectangle with high precision. From a viewpoint of design for a circuit that drives an LED, it is important to design a sophisticated LED driver that can stably output a current peak value and PWM even with a lightening rate of 10% or lower.

[PWM Light Control According to an Embodiment of the Invention]

Figure 4:
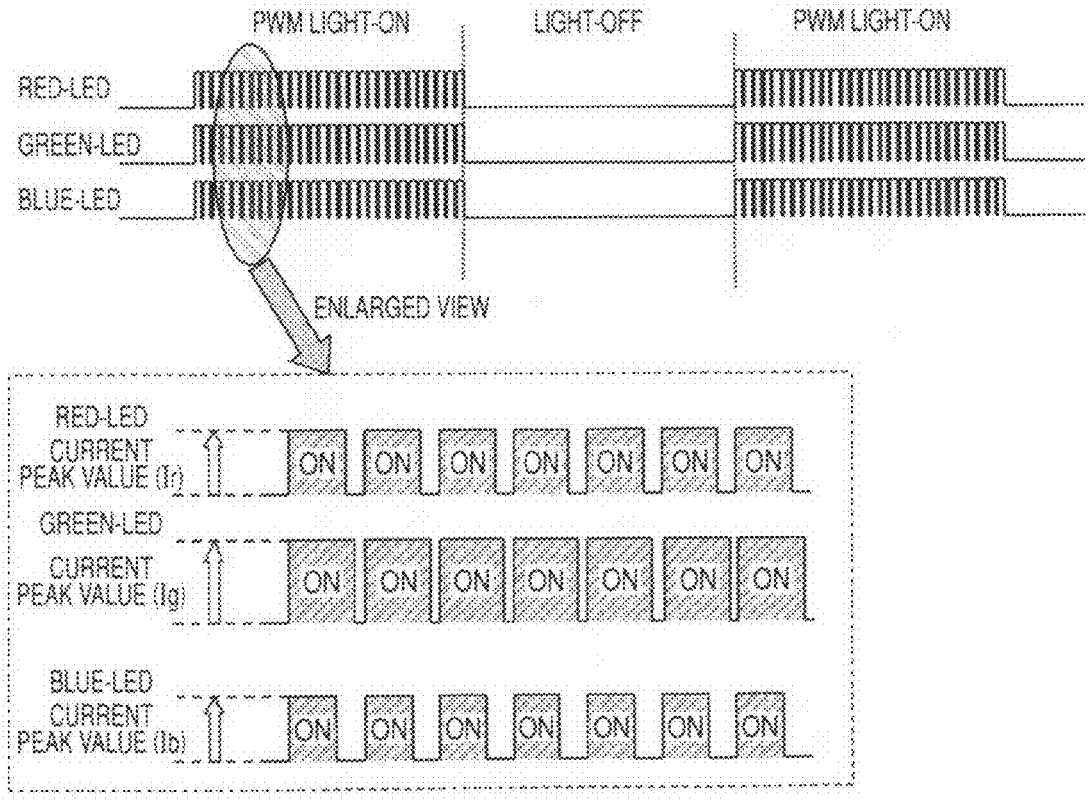
FIG. 4 is a schematic diagram illustrating a quantity-of-light adjusting method for a display apparatus according to an embodiment of the invention.

FIG. 4 is a schematic diagram illustrating a quantity-of-light adjusting method for a display apparatus according to an embodiment of the invention. A quantity-of-light adjusting method for a display apparatus according to an embodiment of the invention performs control with the ratio of a light-on period with PWM to a light-off period when the light source is turned off in order to adjust the quantity of light of a light source with PWM.

As shown in FIG. 4, the lighting of RGB LEDs includes the repetition of the light-on period with the existing PWM (which will be called Main-PWM) and the light-off period when the LEDs are inhibited to emit light, and the average amount of current to be given to the LEDs is controlled with the ratio of the periods.

In other words, during the light-on period with PWM, RGB LEDs are turned on with general PWM by using predetermined pulse width for the colors in consideration of the white balance among the RGB LEDs. A light-on period with PWM and a light-off period in which LEDs are turned off are provided, and the light-on period with PWM and the light-off period are repeated at predetermined frequencies. Changing the ratio of the light-on period to the light-off period can adjust the average amount of current to be fed to the LEDs even with a constant pulse width in the light-on period with PWM. Therefore, even with a constant pulse width with PWM, a lower quantity of light (luminance) can be obtained as a whole than that under PWM light control.

Here, the frequency for repeating the light-on period with PWM and the light-off period when LEDs are turned off is a lower frequency (which will be called Sub-PWM) than the PWM frequency in the light-on period. By adjusting the ratio of the light-on period with PWM to the light-off period when LEDs are turned off through the repetition of them to control the quantity of light, the pulse width with PWM can be maintained by keeping the chromaticity can have a constant value. At the same time, with the pulse width, the entire luminance can be decreased more than that of the case of the PWM light control.

According to this embodiment, it is assumed that the frequency for Main-PWM is approximately 40 kHz, for example, and the frequency for Sub-PWM is approximately 120 Hz, for example. By adjusting the two kinds of PWM, constant chromaticity can be kept even with low luminance.

[Specific Light Control Method]

[1] Method for Controlling Luminance Only with Sub-PWM

The average current values for RGB are:

Red: (MPMR/1024)×Ir;

Green: (MPMG/1024)×Ig

Blue: (MPMB/1024)×Ib where, in an LED back light, the Main-PWM values (or pulse values) for RGB when a highest brightness is defined with an arbitrary chromaticity are MPMR, MPMG and MPMB, the resolution for PWM may be 10 bits, for example, and the RGB current peak values are Ir, Ig and Ib.

The average current values for RGB with a lower luminance are:

Red: (MPMR/1024)×Ir×(SPMR/1024);

Green: (MPMG/1024)×Ig×(SPMG/1024)

Blue: (MPMB/1024)×Ib×(SPMB/1024)

where the Sub-PWM values are SPMR, SPMG and SPMB, and the resolution for Sub-PWM may be 10 bits.

Here, in order to perform luminance control only with the Sub-PWM, the MPMR, MPMG and MPMB of the Main-PWM can be adjusted to control the chromaticity to be kept constant. In order to decrease the luminance control to 10% in setting, it is sufficient to decrease SPMR, SMPG and SPMB to 110 approximately, and the adjustable range of the SMPR, SPMG and SPMB is 110 to 1024.

Figure 5:
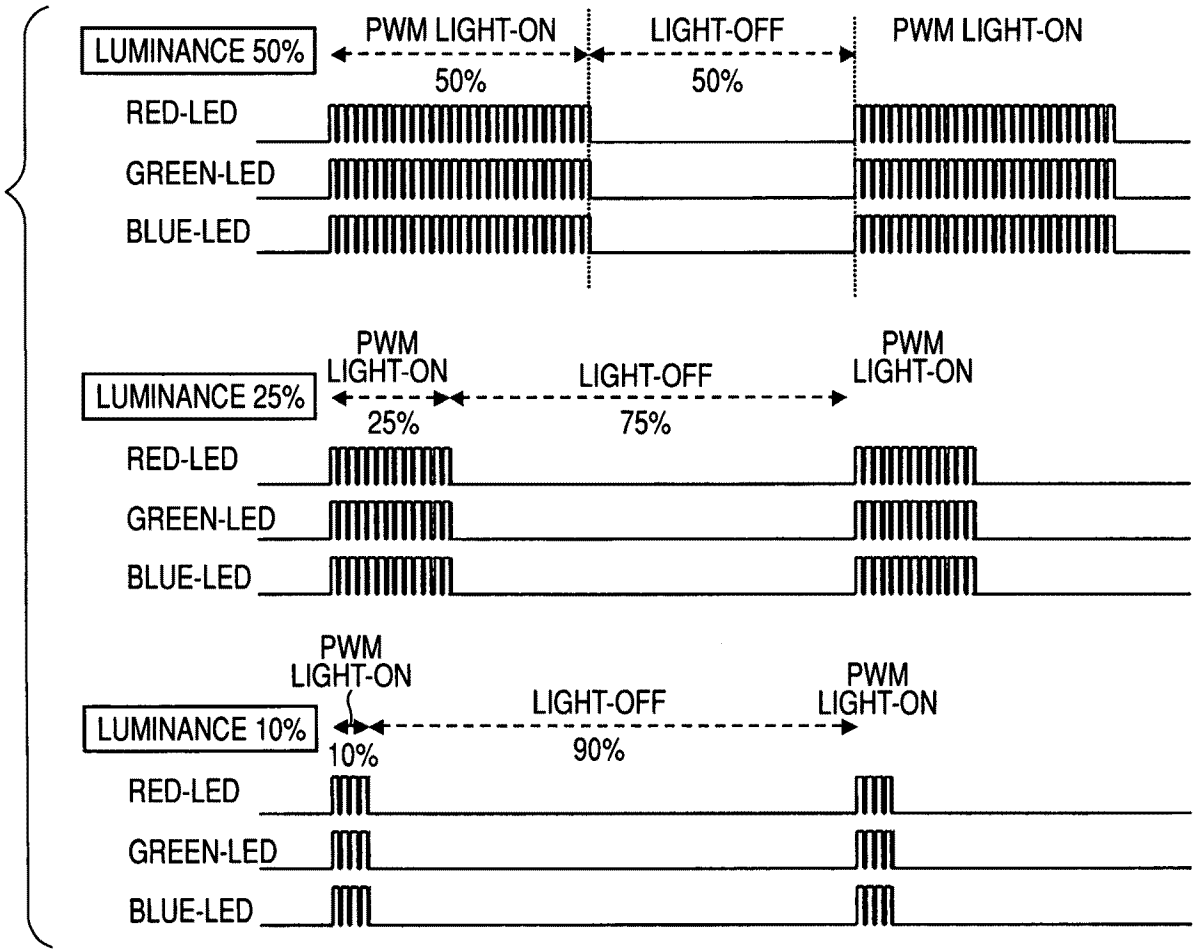
FIG. 5 is a diagram illustrating pulse control in a case where luminance control is performed only with Sub-PWM.

FIG. 5 is a diagram illustrating pulse control in a case where luminance control is performed only with Sub-PWM. FIG. 5 shows examples with luminances 50%, 25% and 10%, respectively. In all of the examples, the entire luminance depends on the ratio of the light-on period with PWM to the light-off period when LEDs are turned off.

[2] Method for Brightness Control with Both of Main-PWM and Sub-PWM

This method performs light control for highest through medium luminances (such as up to 25%) with Main-PWM and performs light control with Sub-PWM for decreasing the luminance more (such as a period from 25% to 10%).

In a case where the frequency of the Sub-PWM is sufficiently higher than the order of a vertical frequency (50 Hz to 120 Hz) of video signals, the luminance control can be performed only with the Sub-PWM without problems. However, in a case with a frequency that is approximately equal thereto, a horizontal jitter occurs, which produces a phenomenon that horizontal displacements of images (aliasing) may appear easily at a high luminance. In a case with a frequency that is exactly equal to the vertical frequency, the light-on/off timing of a back light and liquid crystal driving are completely synchronized. Therefore, the screen unit (or one half of the entire screen with light control of 50%) in timing when the back light is turned off has fixed darkness. For that reason, in a case with light control at a frequency that is exactly equal thereto, the lighting of the back light over the screen is divided, such as back light blinking (the description of which will be omitted herein), and it is important to light on and off the back light. In this way, if the frequency for Sub-PWM is not sufficiently higher than the frequency of video signals, the luminance control with the mix of Main-PWM and Sub-PWM can produce images which do not provide the sense of aliasing easily as described above.

[Configuration of Display Apparatus]

Figure 6:
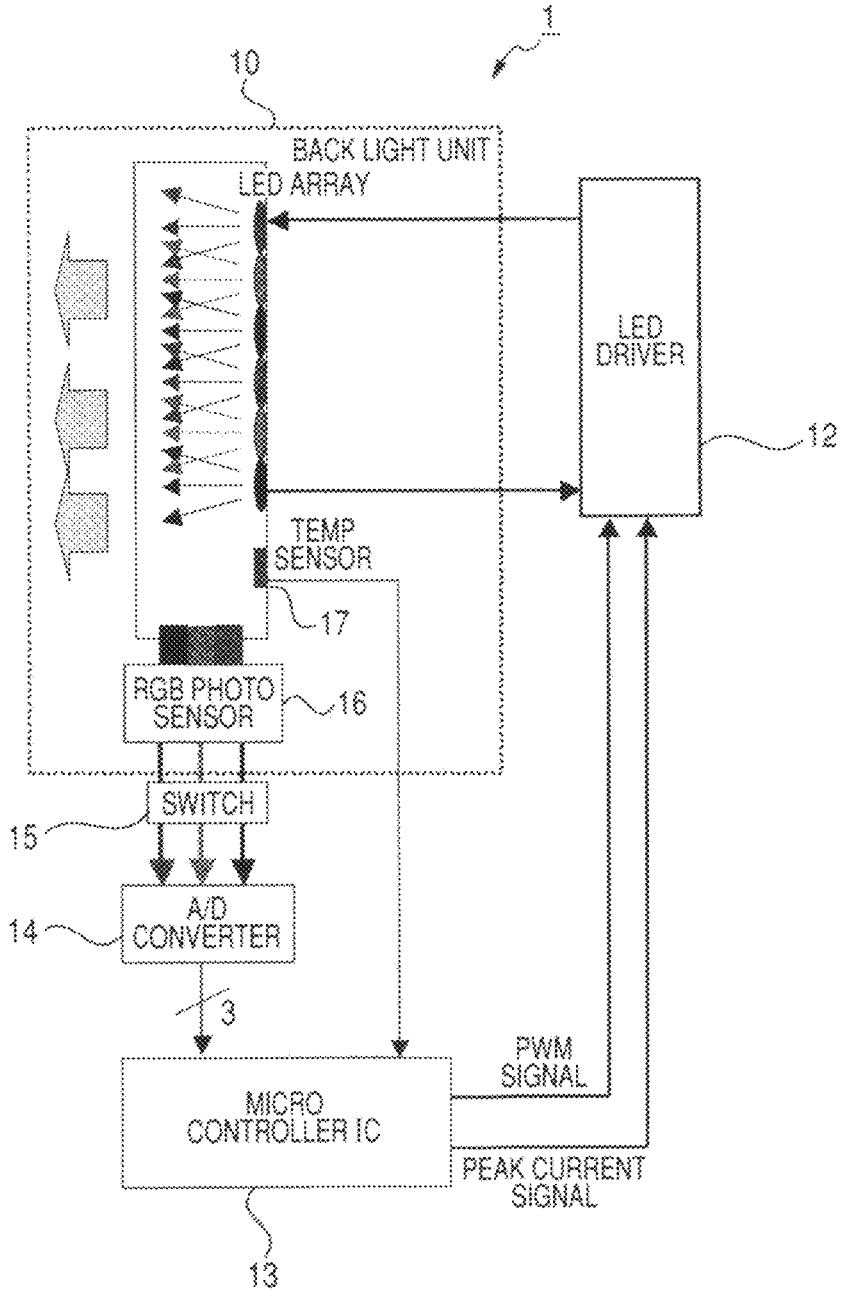
FIG. 6 is a block diagram illustrating a configuration of a display apparatus.

For keeping constant chromaticity, the configuration of a display apparatus as shown in FIG. 6 is also important for both [1] and [2] above. That is, a display apparatus 1 includes a back light unit 10 that irradiates light to display means (such as a liquid crystal panel), an LED driver 12 that feeds current for driving to an LED array 11 of the back light unit 10, and a controller 13 that controls with pulse width modulation the current to be fed from the LED driver 12 to the LED array 11.

The display apparatus 1 includes a control system (or algorithm) in which a color photo sensor 15 detects the quantity of light emitted from the LED array 11, and an A/D converter 14 converts the level of light received by the color photo sensor 15 to a digital signal, which is then fed back to a controller 13. The color photo sensor 15 is controlled in timing for detection through a switch 16, which will be described later. In other words, during a period that the switch 16 is closed according to an instruction given from the controller 13, the detection value by the color photo sensor 15 can be transmitted to the A/D converter 14.

The display apparatus further includes a temperature sensor 17, and based on the temperature detected by the temperature sensor 17, the controller 13 gives an instruction to the LED driver 12 to control the current to be fed to the LED.

Here, a method that adjusts the Main-PWM for RGB is suitable for keeping constant chromaticity for both [1] and [2] above. Defining a light control level of 100% for MPMR, MPMG and MPMB in PWM for RGB, the PWM values are not always MPMR×50/100, MPMG×50/100 and MPMB×50/100 for light control to 50%. For keeping constant chromaticity, it is necessary to slightly adjust the PWM values due to a change in junction temperature when the luminance is changed. Therefore, the PWM values are slightly adjusted as in (MPMR×50/100)±Δpmr, (MPMG×50/100)±Δpmg and (MPMB×5/100)±Δpmb.

The color photo sensor 15 detects the chromaticity as required, and Δpmr, Δpmg and Δpmb vary based on the calculation result by the controller 13 so as to keep constant chromaticity even under light control.

Figure 11:
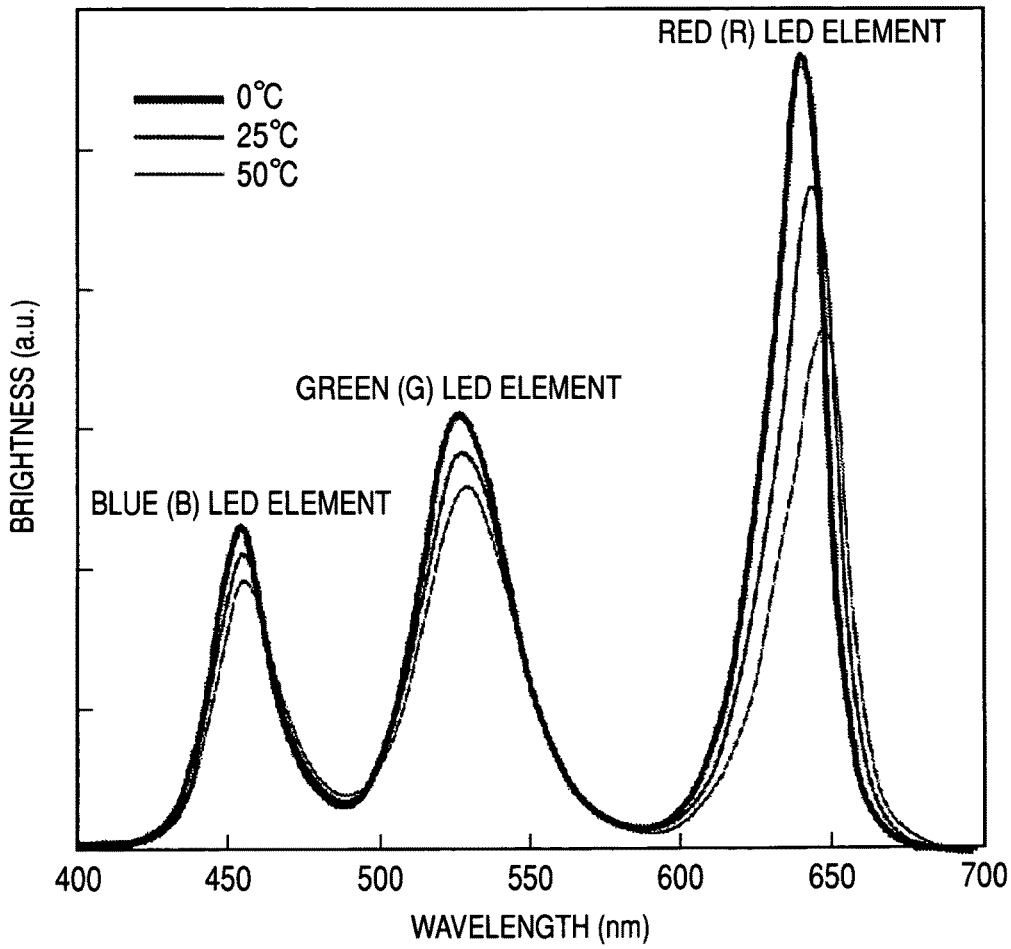
FIG. 11 is a diagram showing changes in peak wavelength against temperatures.

In order to keep constant chromaticity independent of the variation of the back light temperature or luminance, the values detected by the temperature sensor 17 and the color photo sensor 15 are used for feedback control. In other words, since an LED device changes the light emission efficiency and/or peak wavelength according to the temperature as shown in FIG. 11, constant chromaticity is maintained by checking data on the temperature and the luminance levels for RGB, capturing them into the controller 13 and performing calculation processing therefrom as necessary.

Figure 7A:
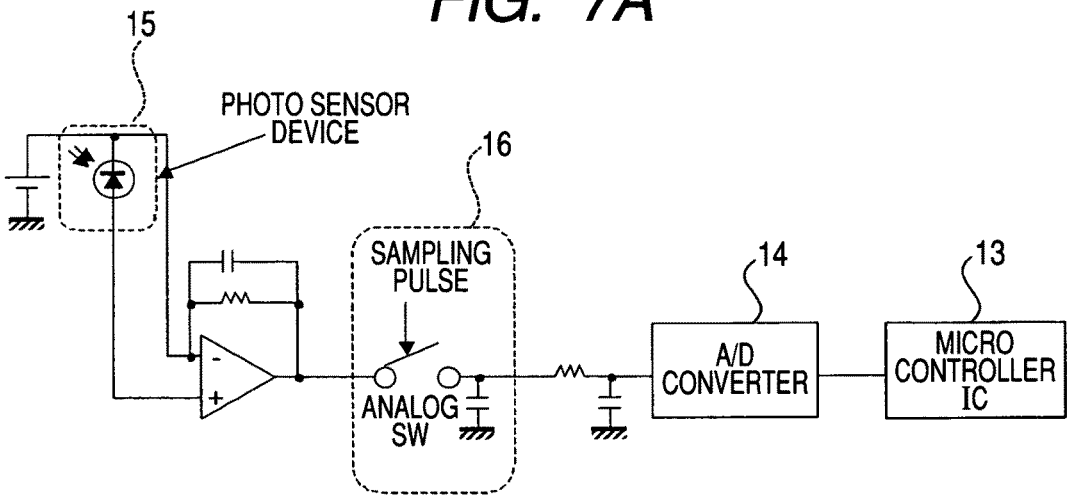
FIGS. 7A and 7B are circuit diagrams illustrating color photo sensor and subsequent circuits.
Figure 7B:
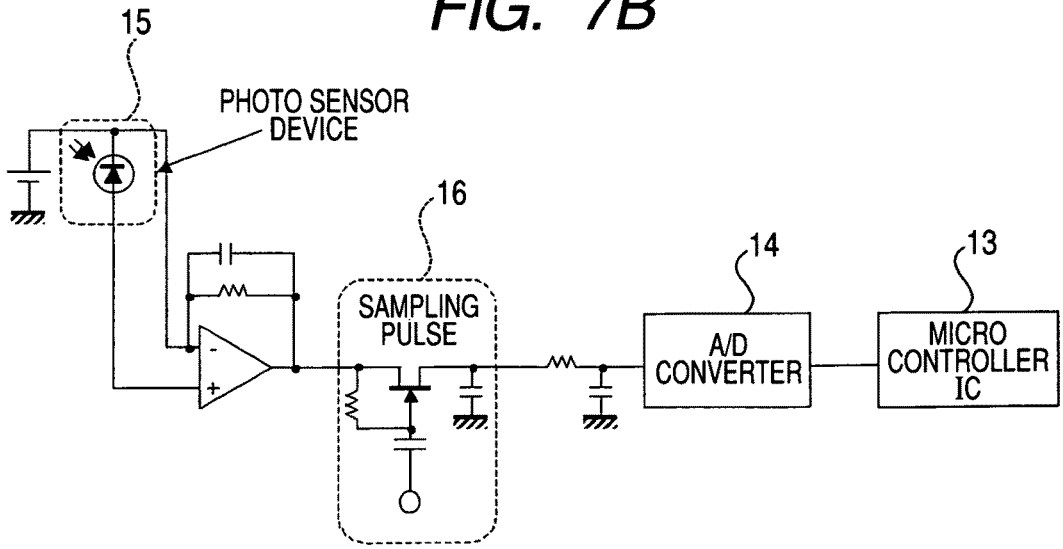

FIGS. 7A and 7B are circuit diagrams illustrating the color photo sensor and subsequent circuits. FIG. 7A shows an example in which an analog switch IC is used as the switch, and FIG. 7B shows an example in which an FET switch is used as the switch. In both of the examples, the switch 16 is provided between the color photo sensor 15 and the A/D converter 14, and a sampling pulse fed from the controller 13 operates the switch 16. The switch 16 is closed in response to a sampling pulse from the controller 13, and the signal detected by the color photo sensor 15 is transmitted from the A/D converter 14 to the controller 13.

Figure 8:
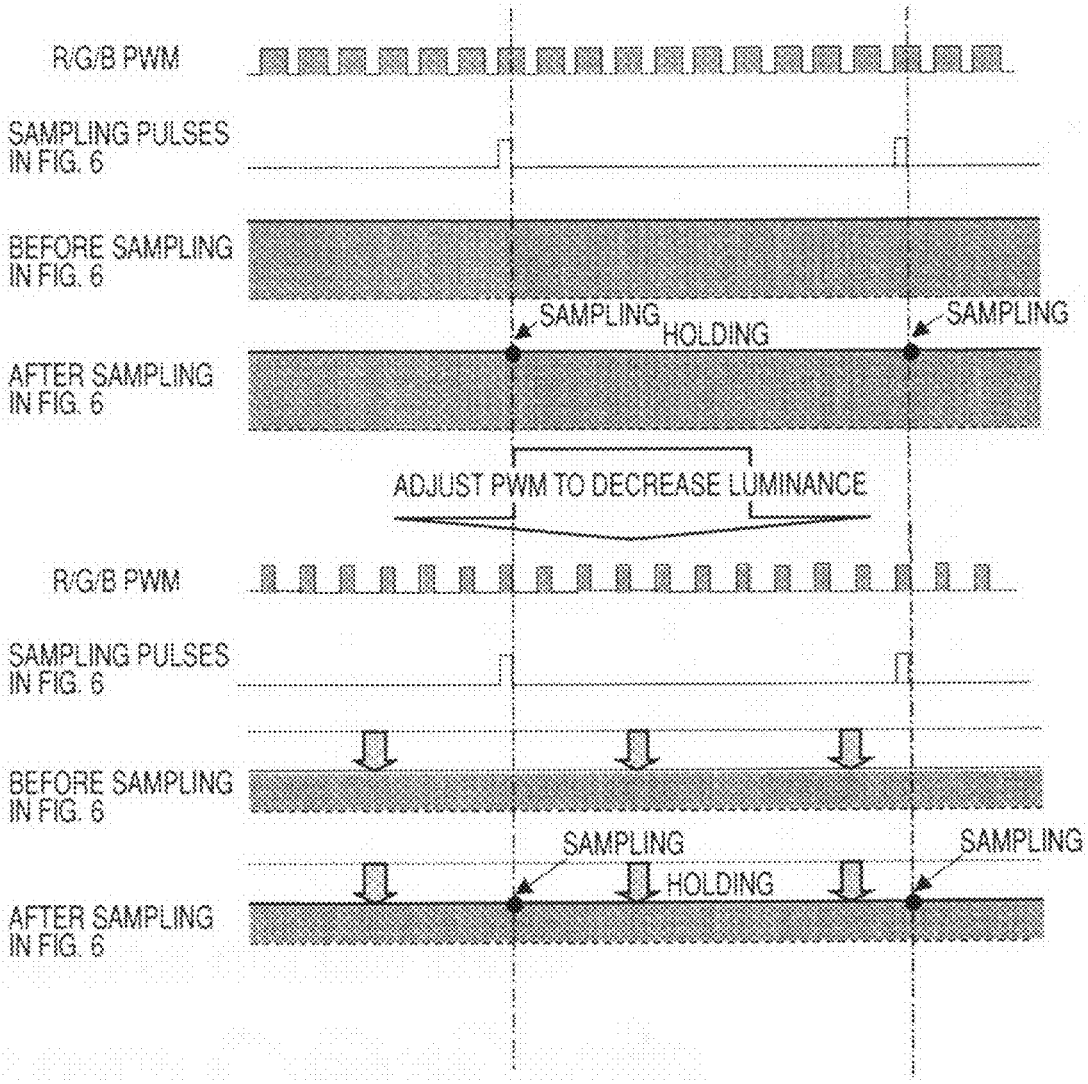
FIG. 8 is a diagram illustrating a case where luminance control is performed only with Main-PWM.

Here, as shown from the top to bottom in FIG. 8, attempting to decrease the luminance without Sub-PWM but only with Main-PWM, the level before sampling of the quantity of light by the color photo sensor evenly decreases with the decrease in pulse width. Thus, the decrease in luminance decreases the read value on the color photo sensor (meaning the voltage level before sampling), resulting in the decrease in precision for keeping constant chromaticity.

Figure 9:
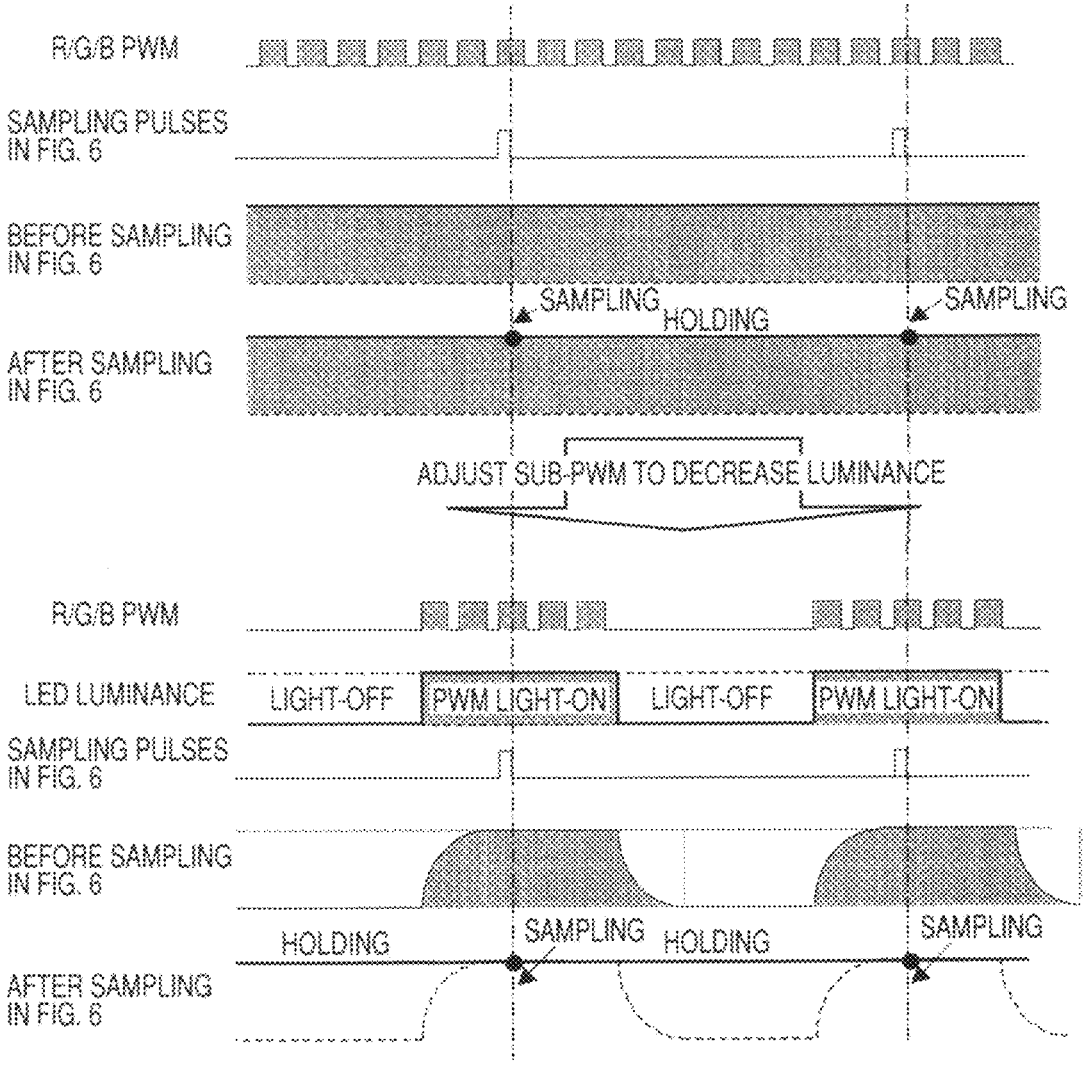
FIG. 9 is a diagram illustrating a case where luminance control is performed by using Sub-PWM.

On the other hand, as shown from the top to bottom in FIG. 9, in order to decrease the luminance in a method that controls luminance with Sub-PWM, the control is performed by adjusting the Sub-PWM with a constant pulse width of the Main-PWM (which increases the light-off period for decreasing the luminance). Therefore, the pulse width is kept higher than a certain constant value by performing the sampling by the color photo sensor during the light-on period with Main-PWM. As a result, the detection can be performed without decreasing the read value on the color photo sensor even with decrease in the entire luminance level.

In this case, the average quantity of light of the entire LED back light can be calculated by performing an operation of multiplying the read value on the color photo sensor by the ratio of the light-on period between the light-on period with Sub-PWM and the light-off period. This detection can eliminate the decrease in read value on the color photo sensor and allows control without decrease in precision for keeping constant chromaticity.

In a case of the method that uses both of Main-PWM and Sub-PWM as described above, the light control is performed with Main-PWM until a predefined value (such as 25%) for the highest luminance is obtained, and the light control is performed with Sub-PWM in order to decrease the luminance to the value lower than the value (for example, 25% to approximately 10%).

In other words, under PWM control over the quantity of light of an LED back light, in order to adjust the quantity of light of the LED back light to a predefined quantity of light or larger, the controller handles the ratio of the light-on period until the pulse width of PWM corresponding to the quantity of light is obtained as 100% and the ratio of the light-off period as 0% to perform pulse width control with PWM. In order to obtain the quantity of light below the predefined quantity of light, control is performed with the ratio of the light-on period to the light-off period by keeping a constant pulse width in PWM.

Figure 10A:
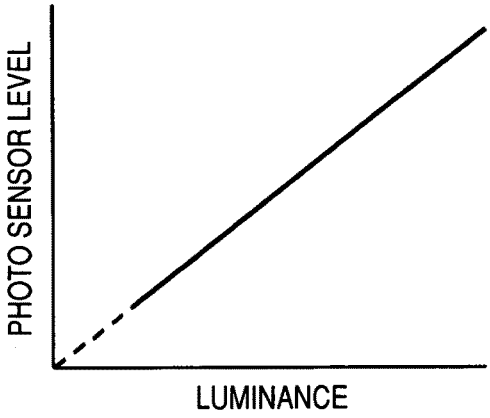
FIGS. 10A and 10B are diagrams comparing a case where light control is performed only with Main-PWM simply and a case where light control is performed to a predetermined quantity of light and with Sub-PWM.
Figure 10B:
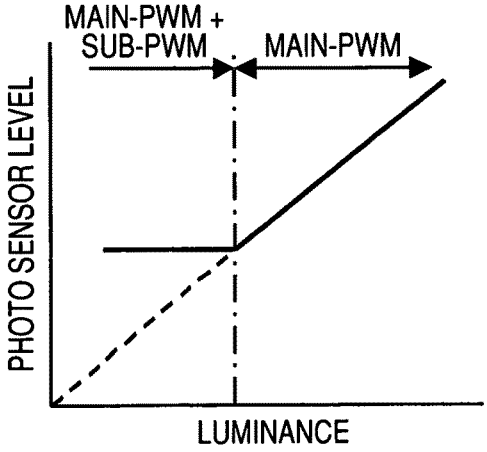

FIGS. 10A and 10B are diagrams comparing a case where light control is performed simply with Main-PWM only and a case where light control is performed with Sub-PWM for light control in the range smaller than a predefined quantity of light. As shown in FIG. 10A, the read value on the color photo sensor as a result of the light control simply with Main-PWM only tends to decrease with a decrease in luminance. On the other hand, as shown in FIG. 10B, when light control is performed with Sub-PWM to a luminance lower than a predefined luminance, a constant value can be read on the color photo sensor with a lower luminance. In other words, since light control with Sub-PWM produces a constant pulse width for Main-PWM, the read value on the color photo sensor corresponding to the constant pulse width can be obtained by detecting the quantity of light by the color photo sensor during the light-on period with Main-PWM. Therefore, the precise detection may allow stable feedback control even with lower luminance.

[Examples of Application to Electronic Equipment]

Figure 12:
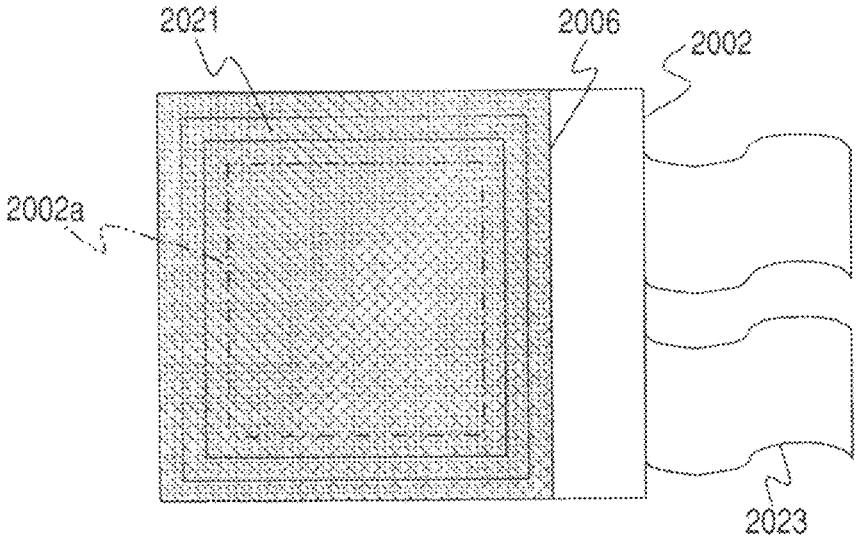
FIG. 12 is a schematic diagram showing an example of a flat module form.

A display apparatus according to an embodiment of the invention includes a flat module form as shown in FIG. 12. For example, a display module may be formed by providing a pixel array unit having the integration in a matrix form of pixels including a liquid crystal element, a thin-film transistor, a thin-film capacity and a photoreceptor on an insulating substrate, placing an adhesive around the pixel array unit (or pixel matrix unit), and pasting a counter substrate of glass, for example, to it. The transparent counter substrate may have a color filter, a protective film, a light-shield film and so on as necessary. The display module may include an FPC (or flexible print circuit), for example, as a connector for inputting/outputting a signal from the outside to the pixel array unit.

The display apparatus according to an embodiment of the invention as described above is applicable to a display apparatus of various electronic equipment shown in FIGS. 13 to 17 or electronic equipment in all fields each of which displays a video signal input to the electronic equipment or a video signal generated within the electronic equipment as an image or a video image, such as a digital camera, a laptop computer, a mobile terminal apparatus such as a cellular phone and a video camera. Examples of the electronic equipment to which an embodiment of the invention is applicable will be described.

Figure 13:
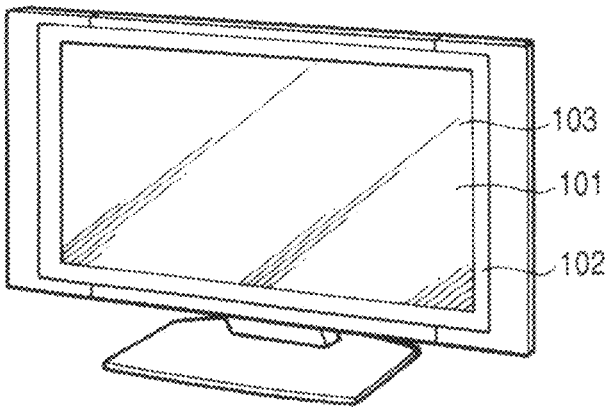
FIG. 13 is a perspective diagram showing a television to which an embodiment of the invention is applied.

FIG. 13 is a perspective view showing a television to which an embodiment of the invention is applicable. A television according to an application example includes a video display screen unit 110 including a front panel 120 and a filter glass 130, and the display apparatus according to an embodiment of the invention may be used as the video display screen unit 110 to produce the television.

Figure 14A:
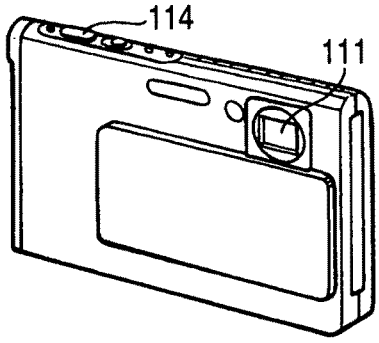
FIGS. 14A and 14B are perspective view showing a digital camera to which an embodiment of the invention is applied.
Figure 14B:
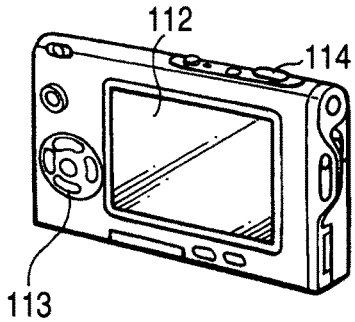

FIGS. 14A and 14B are perspective views showing a digital camera to which an embodiment of the invention is applicable. FIG. 14A is a perspective view from the front side, and FIG. 14B is a perspective view from the back side. A digital camera according to an application example includes a flash light emitting unit 111, a display unit 112, a menu switch 113 and a shutter button 114, and the display apparatus according to an embodiment of the invention may be used as the display unit 112 to produce the digital camera.

Figure 15:
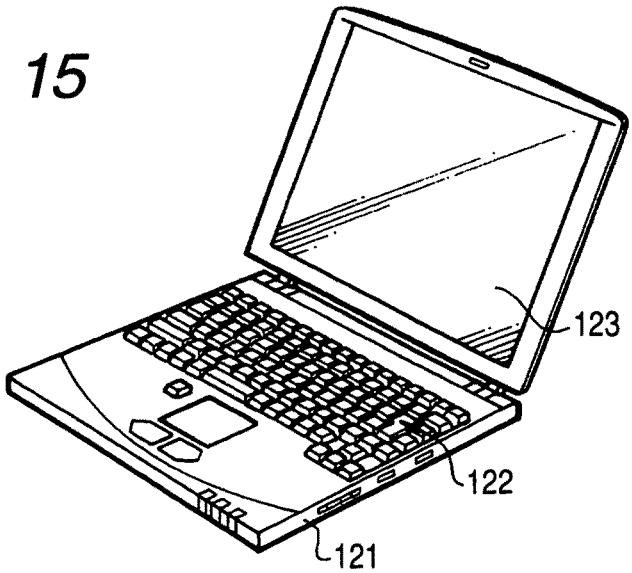
FIG. 15 is a perspective view showing a laptop personal computer to which an embodiment of the invention is applied.

FIG. 15 is a perspective view showing a laptop personal computer to which an embodiment of the invention is applicable. A laptop personal computer according to an application example includes, in a body 121, a keyboard 122 to be operated for inputting text, for example, and a display unit 123 that displays images, and the display apparatus according to an embodiment of the invention may be used as the display unit 123 to produce the personal computer.

Figure 16:
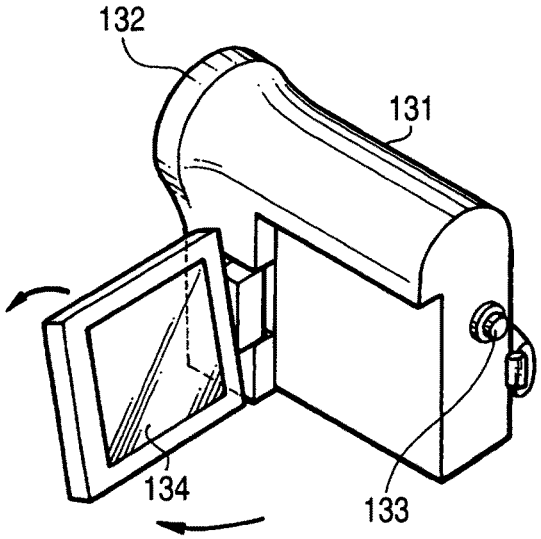
FIG. 16 is a perspective view showing a video camera to which an embodiment of the invention is applied.

FIG. 16 is a perspective view showing a video camera to which an embodiment of the invention is applicable. A video camera according to an application example includes a body unit 131, a subject-photographing lens 132 on a front-facing side, a photographing start/stop switch 133 and a display unit 134, and the display apparatus according to an embodiment of the invention may be used as the display unit 134 to produce the video camera.

Figures 17A, 17B, 17C, 17D, 17E, 17F, 17G:
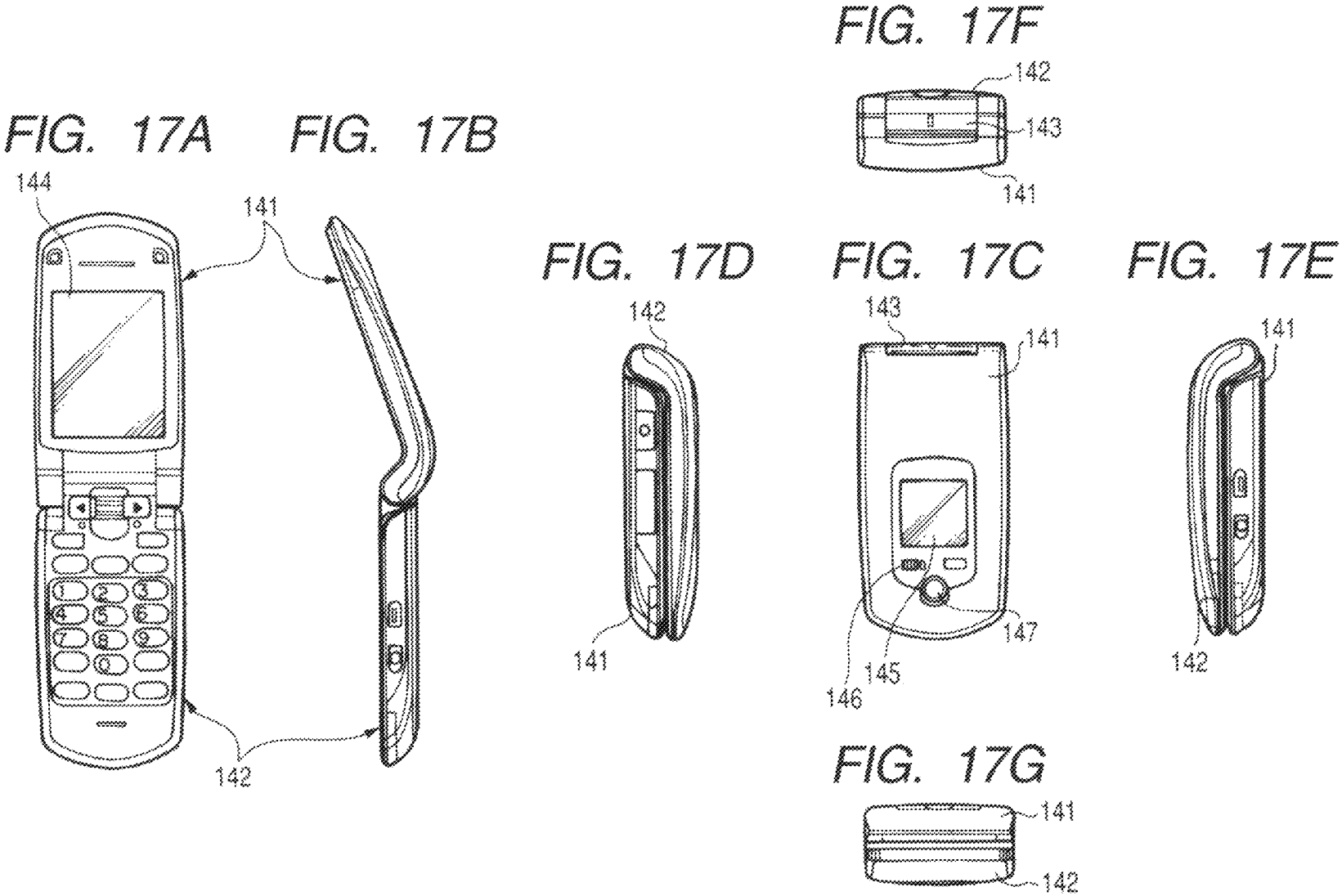
FIGS. 17A to 17G are diagrams showing a mobile terminal apparatus, such as a cellular phone, to which an embodiment of the invention is applied.

FIGS. 17A to 17G are diagrams showing a mobile terminal apparatus, such as a cellular phone, to which an embodiment of the invention is applicable. FIG. 17A is a front view with the cellular phone opened. FIG. 17B is the side view. FIG. 17C is a front view with the cellular phone closed. FIG. 17D is a left elevation view. FIG. 17E is a right elevation view. FIG. 17F is a top view. FIG. 17G is a bottom view. A cellular phone according to an application example includes an upper chassis 141, a lower chassis 142, a connecting unit (which is a hinge here) 143, a display 144, a sub-display 145, a picture light 146 and a camera 147, and the display apparatus according to an embodiment of the invention may be used as the display 144 and/or the sub-display 145 to produce the cellular phone.

[Display/Imaging Apparatus]

Figure 18:
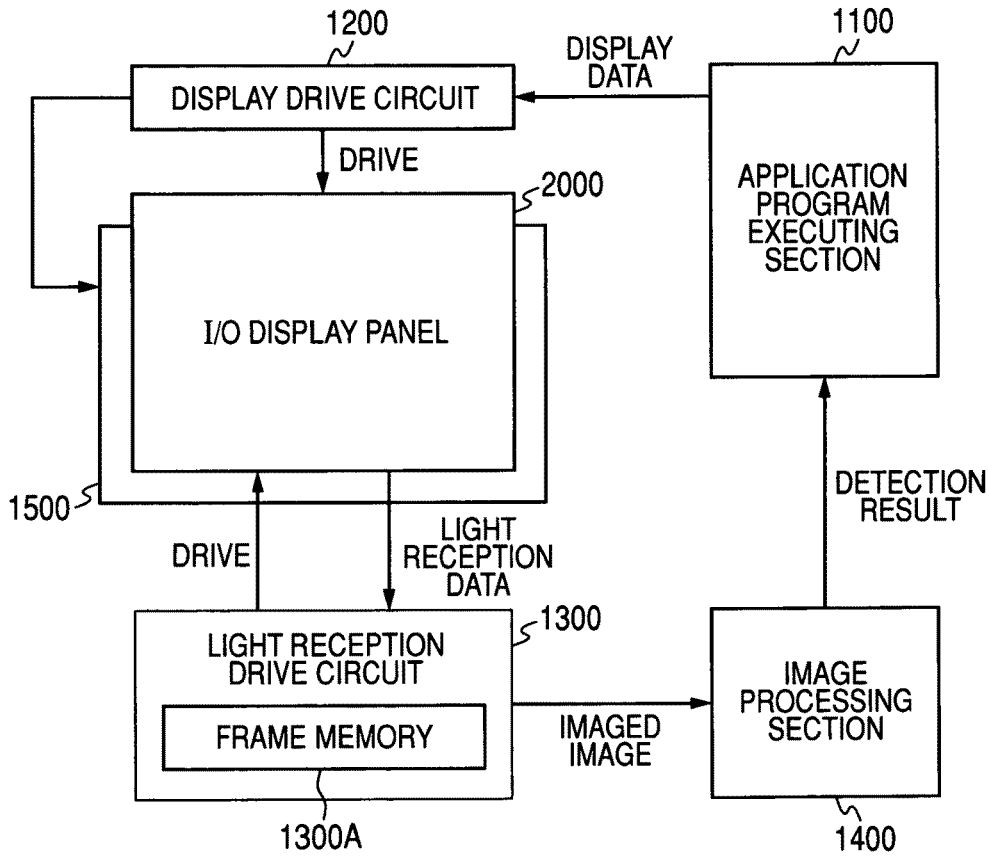
FIG. 18 is a block diagram showing a configuration of a display/imaging apparatus according to an embodiment of the invention.

A display/imaging apparatus according to an embodiment of the invention is applicable to the aforesaid electronic apparatus, and the display apparatus is further applicable to display/imaging apparatus which will be described below. FIG. 18 shows the entire configuration of a display/imaging apparatus. The display/imaging apparatus includes an I/O display panel 2000, a back light 1500, a display drive circuit 1200, a light-receiving drive circuit 1300, an image processing section 1400 and an application program executing section 1100.

The I/O display panel 2000 includes a liquid crystal panel (or LCD) having multiple pixels in a matrix form all over the panel. The I/O display panel 2000 has a function (or display function) of displaying an image such as a predetermined figure or text based on display data by performing a line-sequential operation and a function (or imaging function) of imaging an object in contact with or near the I/O display 2000 as will be described later. The back light 1500 is a light source for the I/O display panel 2000 having multiple light emitting diodes, for example, and undergoes an ON/OFF operation quickly at a predetermined time in synchronization with the operation timing of the I/O display 2000 as will be described later.

The display drive circuit 1200 is a circuit that drives (a line-sequential operation of) the I/O display panel 2000 such that the I/O display panel 2000 can display (or perform a display operation on) an image based on display data.

The light-receiving drive circuit 1300 is a circuit that drives (a linear-sequential operation of) the I/O display panel 2000 such that the I/O display panel 2000 can obtain light reception data (or can image an object). The light reception data by pixels in frames are stored in a frame memory 1300A and is output to the image processing section 14 as an imaged image.

The image processing section 1400 performs a predetermined image process (operation process) based on the imaged image output from the light-receiving drive circuit 1300 and detects and obtains information on an object in contact with or near the I/O display 2000 (such as positional coordinates data and data on the form or size of the object).

The application program executing section 1100 executes processing according to predetermined application software based on the detection result by the image processing section 1400 and may include the positional coordinates of an object in display data and causes it to be displayed on the I/O display panel 2000. The display data created by the application program executing section 1100 is supplied to the display drive circuit 1200.

Figure 19:
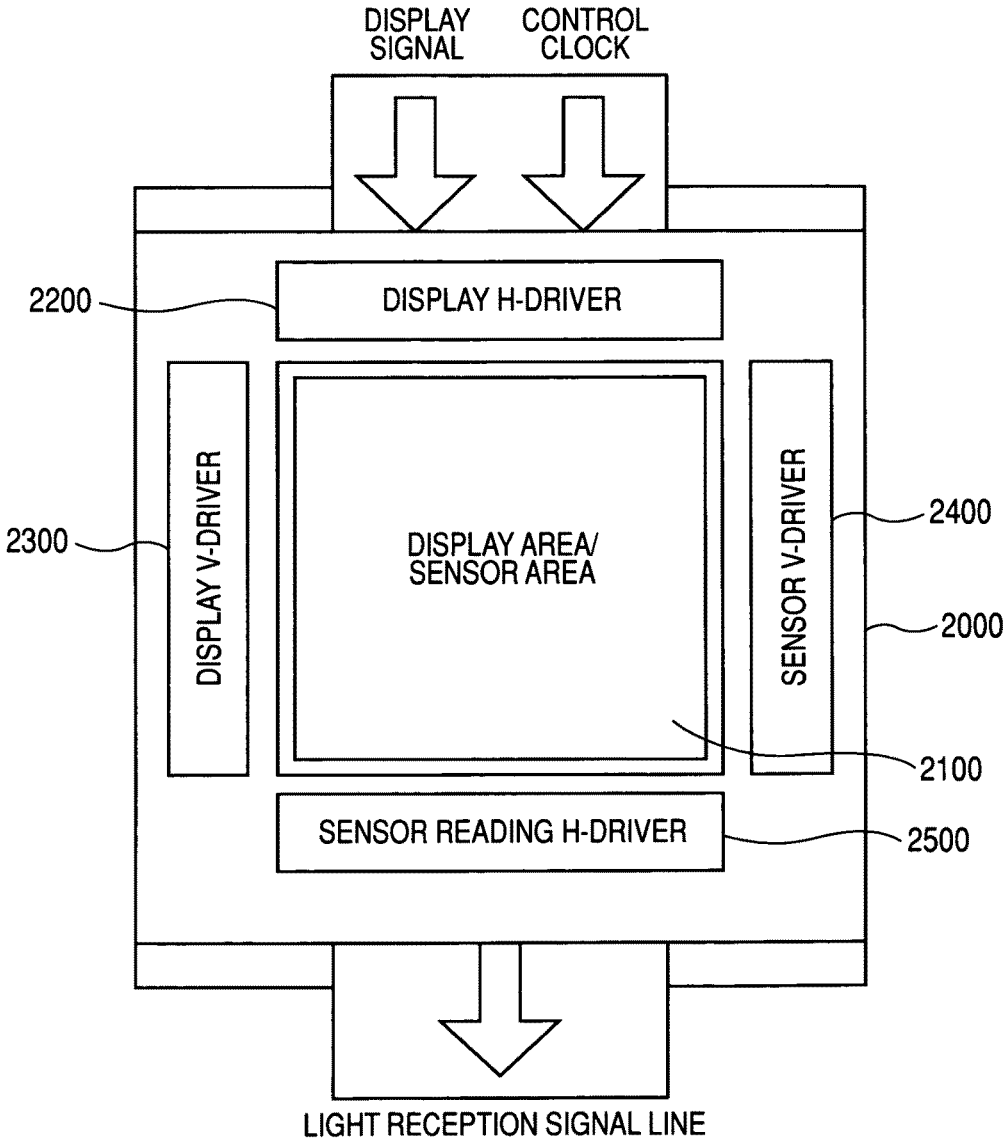
FIG. 19 is a block diagram showing a configuration example of an I/O display panel shown in FIG. 18.

Next, with reference to FIG. 19, a detail configuration example of the I/O display panel 2000 will be described. The I/O display panel 2000 has a display area (or sensor area) 2100, a display H-driver 2200, a display V-driver 2300, a sensor-reading H-driver 2500 and a sensor V-driver 2400.

The display area (or sensor area) 2100 is an area that modulates light from the back light 1500 and emits display light and images an object in contact with or near the area and has liquid crystal elements, which is a light-emitting element (or display element), and photoreceptors (imaging devices), which will be described later, in a matrix form.

The display H-driver 2200 line-sequentially drives the liquid crystal elements of pixels within the display area 2100 along with the display V-driver 2300 based on a display signal and control clock for display driving, which are supplied from the display drive circuit 1200.

The sensor-reading H-driver 2500 line-sequentially drives the photoreceptors of respective pixels within the sensor area 2100 along with the sensor V-driver 2400 and obtains a light reception signal.

Figure 20:
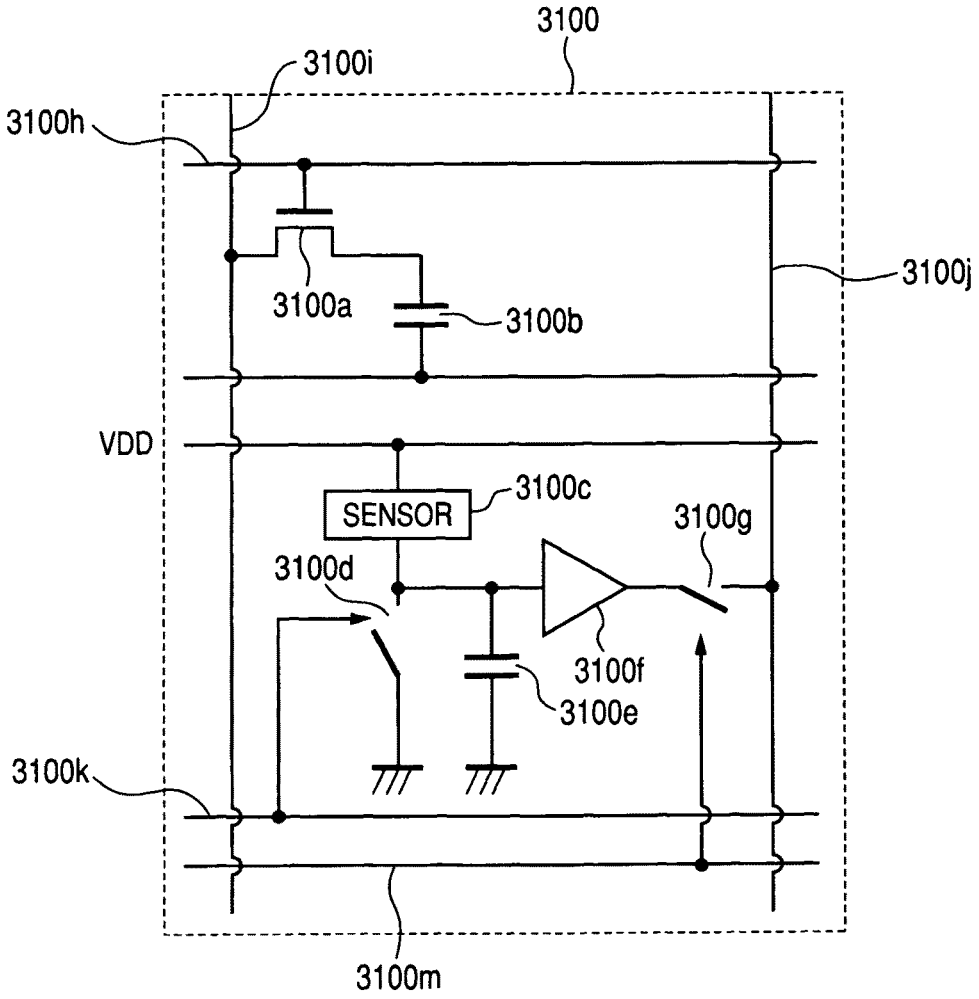
FIG. 20 is a circuit diagram showing a configuration example of each pixel.

Next, with reference to FIG. 20, a detail configuration example of pixels in the display area 2100 will be described. The pixel 3100 shown in FIG. 20 includes a liquid crystal element, which is a display element, and a photoreceptor.

More specifically, on the display element side, a switching element 3100*a* including a thin film transistor (or TFT) is placed at the intersection point of a gate electrode 3100*h*, which extends horizontally, and a drain electrode 3100*i*, which extends vertically, and a pixel electrode 3100*b* including liquid crystal is placed between the switching element 3100*a* and a counter electrode. The switching element 3100*a* undergoes an ON/OFF operation based on the drive signal supplied through the gate electrode 3100*h*, and pixel voltage is applied to the pixel electrode 3100*b* based on the display signal supplied through the drain electrode 3100*i* at the ON-state to set a display state.

On the photoreceptor side adjacent to the display element on the other hand, a light-receiving sensor 3100*c* including a photodiode, for example, is placed and receives the supply of power supply voltage VDD. A reset switch 3100*d* and a capacitor 3100*e* are connected to the light-receiving sensor 3100*c*. The light-receiving sensor 3100*c* is reset by the reset switch 3100*d*, and, at the same time, charges corresponding to the quantity of received light are accumulated in the capacitor 3100*e*. Then, the accumulated charges are supplied to a signal output electrode 3100*j* through a buffer amplifier 3100*f* when a reading switch 3100*g* is turned on and are then output to the outside. The ON/OFF operation on the reset switch 3100*d* is controlled by the signal supplied by a reset electrode 3100*k*, and the ON/OFF operation on the reading switch 3100*g* is controlled by the signal supplied by a reading control electrode 3100*k*.

Figure 21:
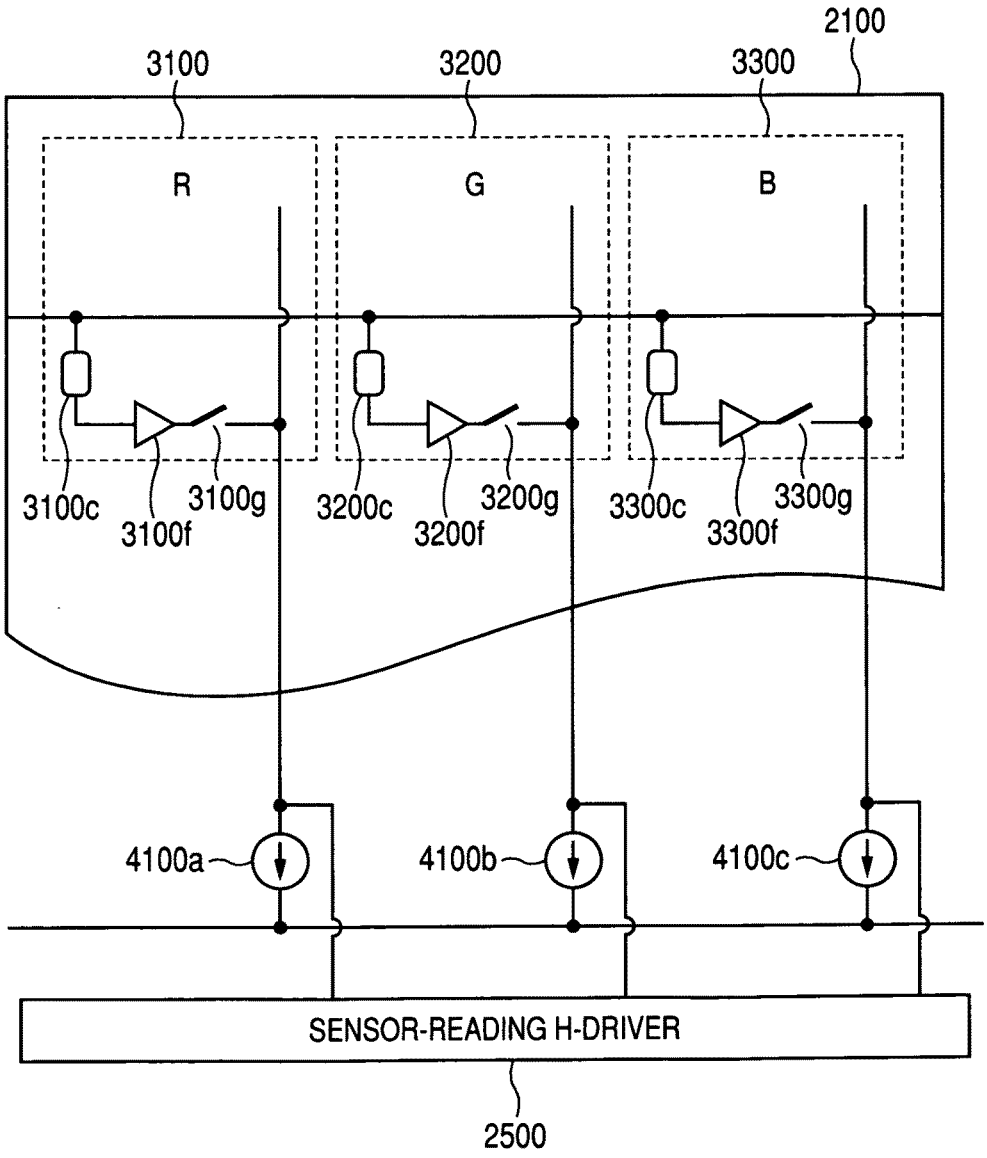
FIG. 21 is a circuit diagram for explaining a connection relationship between pixels and sensor readout H-driver.

Next, with reference to FIG. 21, a connection relationship between pixels within the display area 2100 and the sensor-reading H-driver 2500 will be described. In the display area 2100, red (R) pixels 3100, green (G) pixels 3200 and blue (B) pixels 3300 are aligned.

The charges accumulated in capacitors connecting to light-receiving sensors 3100*c*, 3200*c* and 3300*c* of pixels are amplified by respective buffer amplifiers 3100*f*, 3200*f* and 3300*f* and are supplied to the sensor-reading H-driver 2500 through signal output electrodes when reading switches 3100*g*, 3200*g* and 3300*g* are turned on. Constant current sources 4100*a*, 4100*b* and 4100*c* are respectively connected to the signal output electrodes such that the signal corresponding to the quantity of received light can be detected by the sensor-reading H-driver 2500.

Next, an operation by the display/imaging apparatus according to the embodiment will be described in detail.

First of all, basic operations of the display/imaging apparatus, that is, an operation for displaying an image and an operation for imaging an object will be described.

In the display/imaging apparatus, a drive signal for display is generated in the display drive circuit 1200 based on the display data supplied from the application program executing section 1100, and the drive signal line-sequentially drives the I/O display 2000 to display. Thus, the image is displayed. At the same time, the back light 1500 is also driven by the display drive circuit 1200, and a light-on/off operation in synchronization with the I/O display 2000 is performed.

It should be understood by those skilled in the art that various modifications, combinations, sub-combinations and alterations may occur depending on design requirements and other factors insofar as they are within the scope of the appended claims or the equivalents thereof.

What is claimed is:

1. A quantity-of-light adjusting method for a display apparatus, which controls with pulse width modulation a quantity of light of a light source irradiating light onto a display configured to display an image, the method comprising:

controlling the quantity of light of the light source by varying a ratio of a light-on period, during which the light source is repeatedly turned on and off using the pulse width modulation, to a light-off period, during which the light source remains off for an interval that is longer than any interval that the light source is turned off using the pulse width modulation, wherein to adjust a highest quantity of light of the light source to be a predefined quantity of light or larger, performing control by setting the ratio of the light-on period at 100% and varying the pulse width of the pulse width modulation until a pulse width corresponding to the quantity of light is obtained, in which the predefined quantity of light is approximately 25% of the light, and when the highest quantity of light of the light source is adjusted to be in a range of the approximately 25% of the light or larger, to adjust the quantity of light of the light source to a quantity of light in a range of approximately 10% of the light or smaller, performing control by varying the ratio of the light-on period to the light-off period while keeping the pulse width constant.

2. The quantity-of-light adjusting method for a display apparatus according to claim 1, further comprising:

detecting the quantity of light of the light source; and controlling to feed back the quantity of light of the light source based on the detected quantity of light, wherein the quantity of light is detected during a predetermined period within the light-on period.

3. The quantity-of-light adjusting method for a display apparatus according to claim 1, further comprising:

sensing a temperature of the light source, and adjusting the current supplied to the light source based on the sensed temperature.

4. Electronic equipment, comprising:

a display apparatus on a chassis, the display apparatus including:

a display configured to display an image, a light source that irradiates light to the display means, and a controller configured to control the quantity of light of the light source with pulse width modulation, wherein the controller controls the quantity of light of the light source by varying a ratio of a light-on period, during which the light source is repeatedly turned on and off using the pulse width modulation, to a light-off period, during which the light source remains off for an interval that is longer than any interval that the light source is turned off using the pulse width modulation, and to adjust a highest quantity of light of the light source to be a predefined quantity of light or larger, the controller performs control by setting the ratio of the light-on period at 100% and varying the pulse width of the pulse width modulation until a pulse width corresponding to the quantity of light is obtained, in which the predefined quantity of light is approximately 25% of the light, and when the highest quantity of light of the light source is adjusted to be in a range of the approximately 25% of the light or larger, to adjust the quantity of light of the light source to a quantity of light in a range of approximately 10% of the light or smaller, the controller performs control by varying the ratio of the light-on period to the light-off period while keeping the pulse width constant.

5. The electronic equipment according to claim 4, further comprising:

a temperature sensor configured to sense a temperature of the light source, wherein the controller performs control to adjust the current supplied to the light source based on the temperature sensed by the temperature sensing means.

6. A display apparatus, comprising:

a display unit configured to display an image;

a light source that irradiates light to the display unit; and a controller configured to control a quantity of light of the light source with pulse width modulation, wherein the controller controls the quantity of light of the light source by changing a ratio of a light-on period, during which the light source is repeatedly turned on and off using the pulse width modulation, to a light-off period, during which the light source remains off for an interval that is longer than any interval that the light source is turned off using the pulse width modulation, and to adjust a highest quantity of light of the light source to be a predefined quantity of light or larger, the controller performs control by setting the ratio of the light-on period at 100% and varying the pulse width of the pulse width modulation until a pulse width corresponding to the quantity of light is obtained, in which the predefined quantity of light is approximately 25% of the light, and when the highest quantity of light of the light source is adjusted to be in a range of the approximately 25% of the light or larger, to adjust the quantity of light of the light source to a quantity of light in a range of approximately 10% of the light or smaller, the controller performs control by varying the ratio of the light-on period to the light-off period while keeping the pulse width constant.

7. The display apparatus according to claim 6, further comprising:

a temperature sensor that senses a temperature of the light source, wherein the controller performs control to adjust the current supplied to the light source based on the temperature sensed by the temperature sensor.

8. The display apparatus according to claim 6, further comprising:

a light detector configured to detect the quantity of light of the light source; and a switch that switches the necessity of detection of the quantity of light by the light receiving means, wherein the controller gives a control signal to the switch to detect the quantity of light by the light detector during a predetermined period within the light-on period.

9. Electronic equipment, comprising:

a display apparatus on a chassis, the display apparatus including:

a display unit configured to display an image, a light source that irradiates light to the display unit, and a controller configured to control a quantity of light of the light source with pulse width modulation, wherein the controller controls the quantity of light of the light source by varying a ratio of a light-on period, during which the light source is repeatedly turned on and off using the pulse width modulation, to a light-off period, during which the light source remains off for an interval that is longer than any interval that the light source is turned off using the pulse width modulation, and to adjust a highest quantity of light of the light source to be a predefined quantity of light or larger, the controller performs control by setting the ratio of the light-on period at 100% and varying the pulse width of the pulse width modulation until a pulse width corresponding to the quantity of light is obtained, in which the predefined quantity of light is approximately 25% of the light, and when the highest quantity of light of the light source is adjusted to be in a range of the approximately 25% of the light or larger, to adjust the quantity of light of the light source to a quantity of light in a range of approximately 10% of the light or smaller, the controller performs control by varying the ratio of the light-on period to the light-off period while keeping the pulse width constant.

10. The electronic equipment according to claim 9, further comprising:

a temperature sensor that senses a temperature of the light source, wherein the controller performs control to adjust the current supplied to the light source based on the temperature sensed by the temperature sensor.

* * * * *